United States Patent [19]

Reid et al.

[11] Patent Number: 4,512,878

[45] Date of Patent: Apr. 23, 1985

[54] USED OIL RE-REFINING

[75] Inventors: Lloyd E. Reid; Keith C. Yao, both of Sarnia, Canada; Douglas G. Ryan, Rockaway, N.J.

[73] Assignee: Exxon Research and Engineering Co., Florham Park, N.J.

[21] Appl. No.: 467,032

[22] Filed: Feb. 16, 1983

[51] Int. Cl.[3] ..... C10M 11/00; C10G 45/00

[52] U.S. Cl. ..... 208/179; 208/184; 208/85; 208/88; 208/89; 208/18

[58] Field of Search ..... 208/179, 184, 185, 186, 208/182, 85, 88, 89, 112, 18

[56] References Cited

U.S. PATENT DOCUMENTS

| | | | |
|---|---|---|---|
| 2,927,634 | 3/1960 | Gudheim | 159/6 |
| 3,348,600 | 10/1967 | Monty | 159/6 |
| 3,787,029 | 4/1975 | Baird et al. | 159/6 WH |
| 3,879,282 | 4/1975 | Johnson | 208/184 |
| 3,901,768 | 8/1975 | Steinbruchel | 202/174 |
| 3,919,076 | 11/1975 | Cutler et al. | 208/179 |
| 3,930,988 | 1/1976 | Johnson | 208/179 |
| 3,980,551 | 9/1976 | Wolk | 208/179 |
| 4,033,859 | 7/1977 | Davidson et al. | 208/179 |
| 4,073,719 | 2/1978 | Whisman et al. | 208/180 |
| 4,073,720 | 2/1978 | Whisman et al. | 208/180 |
| 4,093,479 | 6/1978 | Baird | 159/6 W |
| 4,097,369 | 6/1978 | Ebel et al. | 208/184 |
| 4,101,414 | 7/1978 | Kim et al. | 208/18 |
| 4,140,212 | 2/1979 | O'Blasny et al. | 208/184 |
| 4,151,072 | 4/1979 | Nowack et al. | 208/179 |
| 4,160,692 | 7/1979 | Mitchell et al. | 159/6 W |
| 4,233,140 | 11/1980 | Antonelli et al. | 208/181 |
| 4,287,049 | 9/1981 | Tabler et al. | 208/180 |

FOREIGN PATENT DOCUMENTS

| | | |
|---|---|---|
| 3042094 | 5/1981 | Fed. Rep. of Germany . |
| 7711298 | 4/1979 | Netherlands . |

OTHER PUBLICATIONS

"New Re-refining Technologies of the Western World", Whisman, Jr. Am. Soc. Lub. Eng., vol. 35, 5, pp. 249-253 (249-250) 1979.

Correspondence From Bernd Meinken, Jul. 1, 1980, Thermo Cracking Unit.

"Haberland & Co. and the KTI Waste Oil Re-refining Process", Havemann, Third International Conference on Waste Oil Recovery & Reuse, pp. 83-92, 1978.

"Recent Technology Development in Evaporative Re-refining of Waste Oil", Bishop & Arlidge, Third Int'l Conf. on Waste Oil Rec. & Reuse, pp. 137-150, 1978.

"Thin Film Distillation as a Tool in Re-refining Used Oil", Pauley, Third Int'l Conference on Waste Oil Recovery and Reuse, pp. 151-161, 1978.

"Re-refining Lubricating Oils With the Pfaudler Wiped Film Evaporator" Sybron-Pfaudler Data Sheet 143.

"Spent Oil Re-refining", Antonelli, Third International Conference on Waste Oil Recovery and Reuse, pp. 121-125, 1978.

"A Non-polluting Oil Re-refining Process", Weinstein, et al., Industrial Process Design Pollution Control AICHE Workshop, vol. 6, pp. 24-28, 1975.

"To Hydrotreat Waste Lube Oil", Bethea, et al., Hydrocarbon Processing, pp. 134-136, Sep. 1973.

"A New Process for Reclaiming Spent Lubricating Oil", Bonnefay et al., National Petroleum Refiners Ass'n, National Fuels & Lubricants Meeting Sep. 14-15, 1972.

"Spent Oil Reclaimed Without Acid: Dang Vu Quang, et al., Hydrocarbon Processing, pp. 130-131, Dec. 1976.

"Waste Lubricating Oil Research—Some Innovative Approaches To Reclaiming Used Crank Case Oil", Whisman, et al., Bureau of Mines RI-7925, Jul. 1974.

KTI Waste Lube Oil Re-refining Process, News from Greece; KTI Newsletter, Fall 1982, pp. 18-19.

*Primary Examiner*—Delbert E. Gantz
*Assistant Examiner*—Chung K. Pak
*Attorney, Agent, or Firm*—Joseph J. Allocca

[57] ABSTRACT

Used oils, especially used lubricating oils which are normally considered waste and are discarded or burned, are reclaimed for reuse by a re-refining procedure involving the steps of:

(a) heat soaking the used oil;
(b) distilling the heat soaked oil;
(c) passing the distillate through a guard bed of activated material;
(d) hydrotreating the guard bed treated distillate under standard hydrotreating conditions.

If the used oil to be re-refined contains a quantity of water and/or fuel fraction which the practioner considers sufficiently large to be detrimental, the used oil may be subjected to a dewatering/defueling step prior to being heat soaked.

11 Claims, 1 Drawing Figure

USED OIL RE-REFINING

DESCRIPTION OF THE INVENTION

Used oils, especially used lubricating oils which are normally discarded or burned as waste, are reclaimed for reuse by a rerefining procedure involving the steps of:

(a) heat soaking the used oil;

(b) distilling the heat soaked used oil to produce a distillate and a residue;

(c) passing the distillate through a guard bed of activated material;

(d) hydrotreating the guard bed treated distillate to produce a refined oil product suitable for use as lube oil base stock. If the used oil to be re-refined contains a quantity of water and/or fuel fraction which the practitioner considers sufficiently large to affect the heat soaking operation (by requiring higher pressure than desirable), the used oil may be subjected to a dewatering/defueling step prior to being heat soaked.

BACKGROUND OF THE INVENTION

Used oils, particularly those used as lubricating oils, are normally considered waste once they have been used for their intended purpose, (e.g., crankcase oils etc.) as lubricants and are normally either discarded or burned, either disposal method having deleterious environmental ramifications associated therewith.

Consequently, as an alternative, methods for reclaiming the used oil molecules have been developed, both to reduce the environmental hazard associated with either disposal or burning of the oil, and to conserve valuable molecules which can be refined into basestocks having a quality equivalent to virgin basestocks. Acid/clay treating is of diminishing applicability due to the complexity of the additives employed in modern lubricating oils, as well as in light of the sludge disposal problem associated with acid/clay treatment.

The Phillips (PROP) process combines chemical demetallization with clay/hydrotreating as finishing steps. Used oil is mixed with an aqueous solution of, for example, diammonium phosphate which reacts with metal contaminants to form metallic phosphates which separate from both water and oil due to low solubility. The demetallized oil, after filtration using filter aid and heating, is contacted with a guard bed of clay and hydrotreated over a catalyst, for example Ni/Mo, and stripped (See U.S. Pat. No. 4,151,072).

The chief disadvantage of the PROP technology is the disposal of a large amount of solid wastes associated with the filter cake and spent clay. In addition, a large amount of waste water, originated from the chemical solution, is generated by this technology.

Vacuum distillation followed by hydrofining has been proposed in the literature for waste oil re-refining. The process is characterized by pollution-free operation without incurring sludge and oily-clay wastes. However, the drawback of this process is that contaminants in the distillate, originated from lube additives and/or degraded oil, cannot be removed to a low enough level during the distillation step. As a result, hydrofiner fouling becomes a serious problem.

Dewatering-defueling/solvent extraction/distillation/clay contacting and/or hydrofinishing has also been suggested (See U.S. Pat. Nos. 3,919,076, 4,073,719, 4,073,720). In these processes, various kinds of extraction solvent e.g., propane or a mixture of alcohol and ketone, are used to reduce coking and fouling precursors in the dewatered/defueled waste oil prior to the vacuum distillation. The resulting distillate is further upgraded by clay contacting and/or hydrofinishing. The chief disadvantage of this approach is the complexity of the solvent recovery systems which require high energy consumption, and generate waste chemicals via leakage from the unit.

In addition to the above-mentioned waste oil re-refining technologies, distillation of waste oil in a thin-film or wiped-film evaporator (TFE or WFE) to recover lube distillate is also known in the art ("Recent Technology Development In Evaporative Re-Refining of Waste Oil", Bishop and Arlidge; "Thin-Film Distillation as a Tool in Re-Refining Used Oil", Pauley, both of these articles in Third International Conference on Waste Oil Recovery and Reuse, 1978). However, the distillate has to be further processed in order to make an end-product equivalent to the virgin basestock in quality performance. Heat soaking is also known in the industry as a method for breaking up additive molecules and precipitating a polymer (See U.S. Pat. No. 4,033,859). Predistilling a used oil preferably by steam stripping said oil, within the temperature range of between 480° F. and 650° F. (about 249°-345° C.) for at least 4 hours to remove $NO_x$, light oil components and residual water from the stock prior to distilling the oil in a thin film evaporator is described in U.S. Pat. No. 4,101,414.

Figure 1:
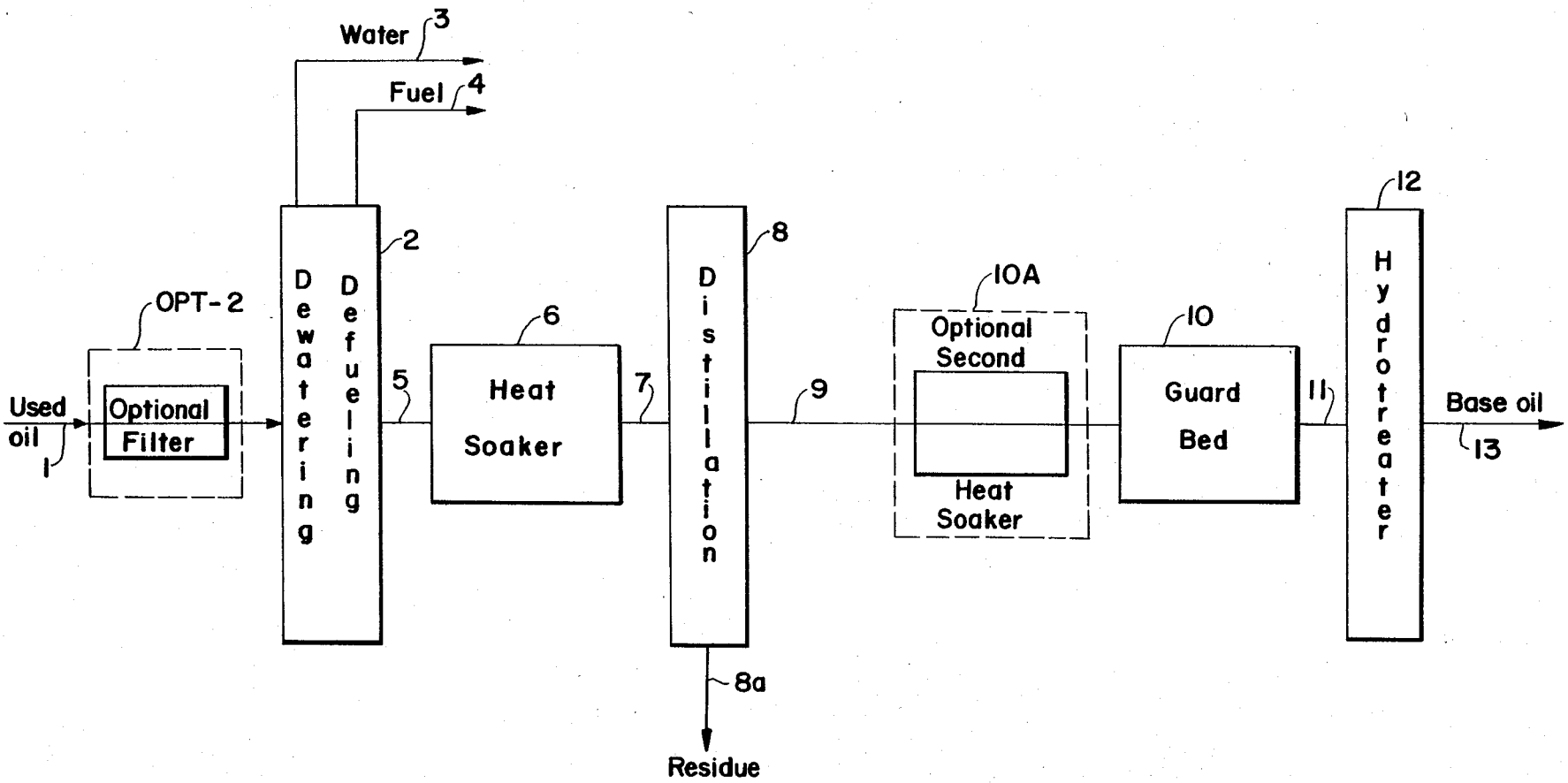
FIG. 1 is a schematic of the processing step sequence of the present invention including a number of optional modifications (identified as such). For the sake of clarity and simplicity, pumps, heaters, piping details, etc. which would be employed in the process and whose location and mode of operation would be within the scope of the ability of those skilled in the art have been omitted, as have the subsequent down stream processing steps which would be or could be practiced on the various effluent streams.

Used oil would be fed via line 1 to an optional dewatering/defueling unit (2) operating under appropriate conditions (to be recited in detail below). Dewatering/defueling can be omitted if the water/fuel concentration in the used oil is determined to be low enough so as not to be detrimental to the overall process, e.g., when the used oil is a transformer oil already of low water and fuel fraction content; however, in most instances, used lube oils of the crankcase oil type, will require a dewatering/defueling step. This dewatering/defueling unit can be a single unit or a number of units, each one designed to handle a separate aspect of the dewatering and defueling. Water and fuel overheads are carried off via lines (3) and (4). The dewatering/defueling operation may be preceded by a filter unit (OPT-2) to remove any grit, solids, metal filings, etc. which may be present in the used oil. The dewatered/defueled used oil is passed via line (5) to a heat soaker (6) and thence via line (7) to a distillation unit (8) which will not coke up under the conditions employed (explained in detail below). Residue from unit (8) is removed via line (8A). The distillate from this unit is sent via line (9) to a guard bed (10) wherein the sludge and halide content is reduced. Optionally, a second heat soaker (10(A)) may precede the guard bed. Effluent from the guard bed (10) is sent via line (11) to a hydrotreater unit (12) wherein the oil is processed to produce an oil product stream (13) which is equivalent to a virgin oil and can be employed as a base oil for the production of oil products such as lube oil, transformer oil, refrigerator oil, turbine oil, white oil, etc. Each processing step in the above-identified sequence is treated in depth below.

THE PRESENT INVENTION

A used oil re-refining process has been discovered which produces a re-refined oil which is comparable to virgin base oils and can be processed into lube, transformer, white oils or other specialties oils etc. The process is not marked by the operational or environmental drawbacks of prior used oil reprocessing procedures.

The re-refining process of the present invention comprises:

(a) heat soaking the used oil;

(b) distilling the heat soaked oil;

(c) passing the distilled oil through a guard bed of activated material;

(d) hydrotreating the guard bed treated oil.

If necessary the use oil can be dewatered/defueled prior to the heat soaking step.

USED OIL FEEDSTOCKS

Basically, any used oil which in the past has been recovered for burning, or for reclamation or has been discarded after use can be the subject feedstream for the present invention. The used oil stream which will be re-refined is predominantly a lube oil (e.g. crankcase oil, etc.) but may contain minor qualities of other specialty oils e.g., transformer oil, white oil, refrigerator oil, etc. and mixtures thereof, but is preferably used lube oil. The used oils subjected to the re-refining procedure of the present invention are relatively free of PCB's, for environmental reasons. Representative of feedstreams which can be employed are the two streams A and B below (Table 1) which are recovered Canadian lubricating oil (motor oil) and are offered merely as illustrations and not by way of limitation. The compositional slate is reported for a target 10 grade lube oil. This slate will of course be different for target oils other than 10 grade, for example 5 or 30 grade oil.

TABLE 1

PROPERTIES OF USED OIL FEEDSTOCKS

| | Feedstock A June, 1980 | Feedstock B May, 1982 |
|---|---|---|
| °API | 25.0 | 25.7 |
| Density, kg/dm$^3$ @ 15° C. | 0.9037 | 0.8996 |
| Viscosity, cSt @ 40° C. | — | 50.4 |
| Composition | | |
| Water (LV %) | 5 | 12 |
| Fuels (LV %) | 12 | 15 |
| 10-grade distillate (LV %) | 68 | 57 |
| Residue (LV %) | 15 | 16 |
| Sulphur, Wt. % | 0.49 | 0.39 |
| Nitrogen, wppm | n.a. | 550 |
| Halogen (Cl/Br), ppm | 770/n.a. | 2500/340 |
| PCB, ppm | <0.1 | 0.4 |
| Metals, ppm | | |
| Pb | 2921 | 2221 |
| Zn | 1229 | 1025 |
| Ca | 1346 | 1010 |
| Mg | 295 | 166 |
| P | 1125 | 980 |

DEWATERING AND DEFUELING THE USED OIL

Removal of water, fuel fraction light hydrocarbons and light vacuum gas oil from used oils is a procedure well-known in the industry. Typically, such dewatering and defueling is performed by atmospheric and/or vacuum distillation, although other procedures such as settling or passage through molecular sieves or treatment with drying agents or selective absorbent or extractants can also be employed. However, for economical and environmental reasons, distillation, be it atmospheric and/or vacuum, is preferred. As an option, and depending on the quality of the used oil being processed, the used oil feedstream can be passed through a filter or other separation means to reduce the level of entrained solids (i.e., dirt, metal filings, sand, etc.) which may be present in the oil prior to the dewatering-/defueling step, so as to reduce the potential for damage to processing equipment and therefore eventually produce a higher quality re-refined basestock oil.

In performing such atmospheric and/or vacuum distillation dewatering and defueling of used oils, standard state-of-the-art procedures, techniques and operating conditions may be employed. As is readily apparent, this dewatering-defueling step will be practiced only when necessary, i.e., only when the used oil to be re-refined possesses a water or light hydrocarbon or light vacuum gas oil fraction which the practitioner is desirous of removing. In some instances the water content and fuel fraction content of the used oil can already be low enough so that the step can be omitted (when the used oil is, for example a transformer oil). This step will, therefor, be most usually practiced on used lube oils such as used motor lubricant oils which are in fact contaminated with water and/or light hydrocarbon (gasoline, diesel fuel) fractions. Typical dewatering/defueling process parameters are those standard distillation temperatures (in the range of 80° to 300° C.) distillation pressures (in the range of 0.5 kPa to atmospheric), reflux ratios (from 0.5/1 to 5/1) and unit throughput presently employed in industry. Dewatering is practiced under conditions and to the extent necessary to remove as much water as possible from the used oil, preferably about 90%, more preferably about 95%, most preferably about 100% of the water present in the used oil stream being processed. During defueling the amount of fuel fraction removed from the used oil and the combination of conditions employed are set by the final characteristics, i.e., the grade of the lube oil distillate which is desired to be recovered after the subsequent distillation step (covered in detail below). For example, a larger fuel fraction, i.e., a high fuel concentration, can be tolerated in the oil when the target is a light oil distillate. Conversely, if a heavier grade oil is sought, a lower concentration of fuel can be tolerated. The extent and severity of the defueling step is left to the discretion of the practitioner to be set in response to the oil characteristics (grade) target of the product to be recovered. In short, the topping severity, i.e., atmospheric equivalent temperature (AET) is regulated by the volatility target of the lube oil to be recovered. In addition to, or as an alternative to conventional distillation in standard distillation towers, thin-film evaporators (TFE), or wiped-film evaporators (WFE) may be employed. These pieces of equipment, TFE or WFE, are described in detail, as are their principles of operation and typical operating conditions, in "Recent Technology Development in Evaporative Re-Refining of Waste Oil" by J. Bishop and D. Arlidge and in "Thin-film Distillation as a Tool in Re-Refining Used Oil" by J. F. Pauley, both articles appearing in Third International Conference on Waste Oil Recovery and Reuse, 1978. See also U.S. Pat. No. 4,073,719, 3,348,600 and 4,160,692 incorporated herein by reference.

As an example, dewatering and defueling of a Canadian used oil by a batch distillation (atmospheric followed by vacuum) is presented in Table 2. In this example, 390° C. AET is required to meet the SAE 10-grade oil volatility target. It is of course clear that different temperatures (AET) will be required when different grades of oil are the target products.

TABLE 2

DEWATERING/DEFUELING OF USED OIL[1] BY BATCH DISTILLATION

| | Dewatering | Defueling[2] |
|---|---|---|
| Distillation Temperature (Vapour), °C. | 100 | 228 |
| Distillation Pressure, kPa | 101 (atmospheric) | 0.887 |
| Atmospheric Equivalent Temperature, °C. | 100 | 390 |
| Yield Range on Raw (Whole) Used Oil, LV % (Material Removed) | i-5 | 5–17 |

[1]Feedstock A in Table 1
[2]Vacuum distillation. The dewatered oil was used as the feed for defueling operation.

Table 3 below shows the results obtained on dewatering/defueling of a Canadian used oil feedstock B (Table 1) using a continuous pilot atmospheric and vacuum (A&V) distillation unit. In many instances vacuum distillation alone will be adequate.

TABLE 3

DEWATERING/DEFUELING OF USED OIL[1] BY CONTINUOUS A & V DISTILLATION

| | Dewatering | Defueling |
|---|---|---|
| Throughput, $m^3/d$ | 2.2 | 1.1 |
| Temperature, °C. (bottom) | 250 | 270 |
| Pressure, kPa | atmospheric | 3.3 |
| Reflux Ratio | No | 3/1 |
| Yield of Overhead (Wt. % on Feed) | 13.8[2] | 12.4 |

[1]Feedstock B in Table 1
[2]It contained 83 wt. % water, 17 wt. % fuels

Dewatering and defueling of the used oil feedstock A using Luwa TFE and Pfaudler WFE are presented in Table 4. In both TFE and WFE distillations, water and fuel streams were obtained as overheads in a single pass operation.

TABLE 4

DISTILLATION OF RAW USED OIL[1]

| Equipment | Luwa TFE | Pfaudler WFE |
|---|---|---|
| Throughput (feed), $kg/m^2$-hr | 344–402 | 180–288 |
| Distillation Temperature (hot oil), °C. | 276 | 264 |
| Distillation pressure, kPa | 1.33–2.0[2] | 4 |
| Overhead Yield on feed, LV % | 17.0 | 16.9 |

[1]Feedstock A in Table 1
[2]Pressure measured at the exit of an external condenser

HEAT SOAKING/TFE OR WFE DISTILLATION

It has been discovered that for the successful practice of the present used oil re-refining process scheme, dewatering and defueling is best followed by a heat soaking step. Further. this heat soaking is best conducted at a temperature range of from about 250° C. to 340° C., preferably 280° C. to 320° C., most preferably 300° C. to 320° C. for a time sufficient to maximize halide (chloride), phosphorus and sludge precursor removal, such times typically being in the range of from about 15 to 120 minutes preferably about 30 to 120 minutes.

The heat soaking is followed by a coke formation resistant distillation step. The distillation is conducted in a manner such that coking in the unit employed is kept to a minimum under the conditions of residence time, temperature and pressure selected to give a distillate having the desired end point. Distillate end point at this step is set by determining whether a light, medium or heavy grade oil is the final material desired upon completion of the overall process. Selection of distillate end point as well as the distillation conditions employed are left to the practitioner to set in response to the final product requirements and the particular distillation apparatus employed in light of the prior recited constraint that coke formation be kept to a minimum. This distillation step is preferably carried out in a coke formation resistant unit such as the cyclonic distillation tower for used oil re-refining described in U.S. Pat. No. 4,140,212, or in a thin film evaporator or a wiped film evaporator due to their higher efficiencies. The TFE and WFE have been previously described.

The key advantage of the preferred TFE (or WFE) distillation is its ability to fractionate unstable material under high temperature/short residence time conditions with minimal degradation or coking. Thus, a unit such as this is ideally suited and preferred for distillation of used lube oil.

Although the majority of foreign materials in the dewatered/defueled used oil, i.e., additives, ash, sludge and wear metals, go to the bottoms during the distillation step, a certain amount of the lube additives (in original or decomposed form) having a boiling point range similar to that of the lube distillate tends to distil over along with the distillate. In addition, a small fraction of these materials which boils outside of the distillate boiling range get entrained in the distillate during the distillation stage. As a result of these effects, the distillate is contaminated with a high concentration of phosphorus (50–300 ppm) and sludge precursors. The latter tend to form a sludge (1,000–3,000 ppm) during high temperature processing (i.e., hydrotreating). Because of the presence of these materials, process problems such as hydrotreating catalyst deactivation and reactor plugging are encountered when contaminated distillate is hydrotreated over conventional catalysts. These phosphorus compounds and sludge precursors were identified as the major causes of catalyst deactivation and bed plugging, respectively. These deficiencies associated with the processing sequence comprised of dewatering, defueling, distillation and hydrotreating can be overcome by heat soaking the dewatered/defueled used oil prior to distillation. Heat soaking causes the majority of the phosphorus compounds and sludge precursors to form high boiling point materials which essentially all go with the residue during the distillation step. This is possible because the dispersant and antifoulant materials in the original lube additive package keep the sludge suspended in the oil which, in turn, prevents equipment fouling.

The benefecial effects of heat soaking prior to distillation on distillate quality, in terms of phosphorus and sludge contents, is shown in Table 5. Dewatered/defueled used oil from a Luwa TFE (Table 4) was continuously heat soaked in a pilot plant set-up at atmospheric pressure, at two temperatures (280° C. and 320° C.) and three residence times (½, 1 and 2 hours) to define the optimum heat-soaking conditions. The tests were carried out with a 0.95 cm I.D. stainless steel tube coil (located in a high temperature sand bath) in a once-through mode.No pressure drop across the heat soaking coil was observed after about 369 hours of smooth operation at 320° C. Distillations of used oils, both raw and heat soaked, were carried out (Table 5) with a lab size Pope WFE (1,100 $cm^2$ evaporation area) to define the effect of heat soaking on distillate quality. Results indicated that relative to the non-heat soaked distillate (base case), the distillate derived from the heat-soaked oil (320° C., ½ hour residence time) threw down about 75% less sludge and contained only 3–8 ppm of phosphorus (versus 240 ppm for the base case). Phosphorus removal increased with increasing heat soaking temperature. At 320° C., the distillate quality in terms of phosphorus and sludge lay-down improved slightly with increasing residence time.

TABLE 5

EFFECT OF PILOT HEAT SOAKING PRIOR TO POPE WFE DISTILLATION ON DISTILLATE QUALITY

| | LUWA Dewatered/Defueled Oil[1] | | | | | |
|---|---|---|---|---|---|---|
| Heating Soaking | None | Yes (Pilot Plant) | | | | |
| Temp., °C. | | 280 | 320 | | 320 | |
| Residence Time, hr. | — | 1.0 | | 0.5 | 1.0 | 2.0 |
| WFE (Pope) Distillation | | | | | | |
| Temp., °C. | 289 | 292 | 289 | 289 | 292 | 298 |
| Pressure, kPa | 0.5 | 0.4 | 0.4 | 0.5 | 0.4 | 0.4 |
| Phosphorus, ppm | 240 | 25 | 6/3 | 8 | 6/3 | 5 |
| Sludge, ppm @ 310° C. | 2030 | 450 | 490 | 460 | 490 | 390 |

[1]See Table 4

The advantages of heat soaking prior to WFE distillation were further demonstrated in a Pfaudler WFE (Table 6). The Pfaudler WFE with its internal deentrainment device produced a much better quality distillate from the (pilot plant) heat soaked used oil than the lab Pope WFE. A comparison of Tables 5 and 6 indicates that at comparable phosphorus levels, the Pfaudler distillate had a significantly lower sludge content. However, it must still be noted that either piece of equipment, after the heat soaking of the dewatered/defueled used oil, gave a distillate product of significantly reduced phosphorus and sludge content when compared with the non-heat soaked material. Either unit gave results fully acceptable for the purposes of the present invention.

TABLE 6

EFFECT OF PILOT HEAT SOAKING PRIOR TO PFAUDLER WFE DISTILLATION ON DISTILLATE QUALITY

| | Dewatered/Defueled Used Oil[1] | |
|---|---|---|
| | NO[2] | YES[3] |
| Heat Soaking | | |
| Temperature, °C. | — | 320 |
| Residence Time, Hr. | — | 0.5 |
| WFE Distillation | | |
| Temperature, °C. | 278 | 288 |
| Pressure, kPa | 0.19 | 0.28 |
| Phosphorus, ppm | 337 | 3 |
| Sludge, ppm at 310° C. | 2860 | 113 |

[1]Derived from feedstock A in Table 1
[2]Dewatered/defueled in Pfaudler WFE (See Table 4)
[3]Carried out in the Pilot Plant. Feed was dewatered/defueled in a batch distillation unit (about 390° C. AET +, other conditions are shown in Table 2)

Another example illustrating the benefits of high temperature heat soaking prior to WFE distillation is shown in Table 7. A large scale pilot plant heat soaking (0.62 $m^3$/D) of A&V dewatered/defueled oil (from Table 3) was carried out over a wide temperature range using a heating coil in connection with a heat soaker. After heat soaking, the oil was pumped to the WFE where it was fractionated into a lube distillate and a residue. Results obtained on the lab (Pope) WFE distillation of heat soaker feed (non-heat soaked) are also shown in the same table for comparison purposes. As shown in Table 7, distillate phosphorus content decreased with increasing heat soaking temperature. A low heat soaking temperature (i.e., <280° C.) resulted in high phosphorus content in the WFE distillate which would give a high rate of catalyst deactivation in the downstream hydrotreating operation. On the other hand, too high a heat soaking temperature (340° C. or above) resulted in a complete decomposition of dispersant type additives (they boil at 340° C. with decomposition). As a result, sludge suspended in oil (about 2 vol.%) started to settle. A non-agitated horizontal heat soaker, while it did function, eventually plugged with settled sludge due to areas of liquid stagnation. The potential operating problem can be effectively avoided by the use of a preferred vertical heat soaker or even a horizontal unit augmented with agitation. In addition, excess amount of light-ends was formed and on-spec viscosity distillate (29–31 cSt @ 40° C.) could not be produced as heat soaking temperature exceeded 340° C. From this it is seen that the optimum heat soaking temperature is between about 300° C.–320° C.

TABLE 7

PILOT PLANT HEAT SOAKING/WFE DISTILLATION OF DEWATERED/DEFUELED OIL[1]

| Heat Soaking | No | | | Yes | | | |
|---|---|---|---|---|---|---|---|
| Temperature, °C. | (2) | 250 | 280 | 300 | 320 | 340[3] | |
| Residence Time, hr | | | | ½ | | | |
| WFE Distillation | | | | | | | |
| Temperature, °C. | 305 | | | 300 | | | |
| Pressure, kPa | 0.27 | 0.27 | 0.27 | 0.27 | 0.20 | 0.20 | |
| WFE Distillate | | | | | | | Target |
| Phosphorus, ppm | 72 | 33 | 24 | 18 | 14 | 12 | |
| Sludge, ppm | — | — | 213 | — | 116 | | |
| Toluene Insolubles, ppm | — | — | 55 | 61 | 60 | (4) | |
| TAN, mg KOH/g | — | — | — | — | — | 0.53 | — |
| Viscosity @ 40° C., cST | 31.64 | 29.60 | 29.40 | 28.57 | 29.39 | 26.50 | 29–31 |

[1]Derived from Feedstock B, Table 1. Dewatering/defueling conditions are shown in Table 3
[2]Lab (Pope) WFE distillation of heat soaker feed
[3]Heating coil skin temperature
[4]Sludge started to settle Some inspections on the residue made from the Pfaudler, WFE using heat-soaked used oil feed is given in Table 8. A study indicated that this residue could be disposed of by blending (until about 8 LV% of the blend is residue) with 85/100 penetration paving asphalt without adversely affecting the asphalt product quality (Table 9). From this it is seen that the process of the present invention does not have the serious hazardous waste disposal/environmental problem associated with it as do typical clay/acid used oil refining techniques.

TABLE 8

INSPECTIONS OF WFE (HEAT SOAKED) RESIDUE[1]

| | |
|---|---|
| Penetration @ 25° C., dmm | >400 |
| Flash point (COC), °C. | 278 |
| Viscosity @ 100° C., cSt | 127 |
| 135° C., cSt | 48 |

TABLE 8-continued

| INSPECTIONS OF WFE (HEAT SOAKED) RESIDUE[1] | |
|---|---|
| Solubility in Trichloroethylene, wt. % | 98.55 |
| Acid No., mg KOH/g | 3.8 |
| Metals, ppm | |
| Pb | 9000 |
| Mg | 1100 |
| Ca | 4700 |
| Zn | 4100 |
| P | 3544 |
| Ba | 256 |

[1]Derived from feedstock A in Table 1

TABLE 9

QUALITY OF ASPHALT/USED OIL RESIDUE BLEND[1]

| | Target Specification | | |
|---|---|---|---|
| | Blend | Min. | Max. |
| 85/100 Penetration Asphalt (Vol %) | 91.6 | | |
| Used Oil Residue Vol %) | 8.4 | | |
| Penetration @ 25° C., dmm | 166 | 150 | 200 |
| Viscosity @ 135° C., cSt | 254 | 200 | |
| Flash (COC), °C. | 312 | 260 | |
| Ductility @ 40° C., cm | >50 | 10 | |
| Solubility in Trichloroethylene, wt. % | 99.5 | 99.5 | |
| Acid No. mg KOH/g | 0.5 | | 0.8 |
| Thin-film Oven Test | | | |
| Change in Weight, % | +0.03 | | 1.3 |
| Retained Penetration @ 25° C. | 62.7 | 42 | |
| Ductility @ 25° C., cm | >150 | 100 | |

[1]See Table 8

HYDROTREATER GUARD BED

Prior to being introduced into the hydrofiner unit, the distillate coming from the previous step is subjected to passage through a guard bed of material suitable for removing various remaining contaminants from the distillate. These contaminants include halides, trace phosphorus and residual sludge remaining in the distillate after distillation.

Various adsorbents (Fuller's Earth, charcoal, lime and activated alumina) were evaluated for removing contaminants from the distillate. In general, solid adsorbents capable of removing phosphorus, halides and residual sludge from the distillate, having high surface area (such as those used in the prior art in clay treating or which are typically used in guard beds in front of hydrotreaters, see e.g., U.S. Pat. Nos. 4,151,072, 3,919,076, 4,073,719, 4,073,720) can be used for this purpose. Results shown in Table 10 indicate that the most effective adsorbent for the guard bed is activated alumina, and for this reason a guard bed of activated alumina is preferred. However, while activated alumina is preferred, it must be noted that all the materials tested demonstrated some ability to remove phosphorus and halides from the distillate.

TABLE 10

BATCH TREATING USED OIL DISTILLATE[1] [2]

| | Feed | Fuller's Earth | Char-coal | Lime | Acti-vated Alumina |
|---|---|---|---|---|---|
| Phosphorous, ppm | 100 | 6 | 18 | 30 | 1 |
| Halogens, ppm | 110 | 12 | 35 | 59 | 9 |

TABLE 10-continued

BATCH TREATING USED OIL DISTILLATE[1] [2]

| | Feed | Fuller's Earth | Char-coal | Lime | Acti-vated Alumina |
|---|---|---|---|---|---|
| Surface Area, $m^2/g$ | — | 98 | 347 | 4.5 | 245 |

[1]Norske Esso 130N TFE distillate

[2]Batch treating conditions: 250° C., 1 h, 4/1 oil/adsorbent weight ratio. Stirred with nitrogen blanket.

Both continuous flow and static batch bed contacting can be used. However, the former is preferred since it can be integrated with the downstream hydrotreating operation. Operating conditions for the guard bed which can be employed include a pressure ranging from about atmospheric to about 5 MPa (700 psi) temperature ranging from about 180° C. to about 340° C. preferably about 280°–320° C., LHSV ranging from about 0.5 to about 2 V/V/hr preferably about 0.5–1.0 V/V/hr. Any inert gas can be used. However, the use of hydrogen as a treat gas is preferred because of integration with the downstream hydrotreater; the use of hydrogen would prevent coke formation in the guard bed.

The use of activated alumina is preferred since, in addition to adsorbing residual sludge from the distillate, the alumina can also remove residual phosphorus as well as high concentrations of halides (chlorides and bromides). It is desirable to remove the halides prior to hydrotreating to avoid the formation of corrosive compounds such as hydrogen chloride and hydrogen bromide in the hydrotreater reactor. The effectiveness of activated alumina for removing phosphorus and halides from used oil distillate, i.e., Norske Esso 130N distillate (77 ppm phosphorus, 90 ppm halogens) was further studied in the Pilot Plant. Adsorption was carried out by passing the distillate mixed with hydrogen in a continuous flow over a fixed bed of activated alumina at from 180° to 320° C., 3.4 MPa $H_2$, 1.0 LHSV and 1.5 $kmol/m^3$ gas rate. The results shown in Table 11 indicated that both the phosphorus and halide contents of the alumina treated oil decreased with increasing temperature. At 320° C., the product phosphorus and the halogen content was 1 ppm and 17 ppm, respectively.

TABLE 11

ALUMINA TREATING WASTE OIL DISTILLATE (PILOT PLANT RESULTS)[3]

| | Luwa TFE Distillate[1] | | | | |
|---|---|---|---|---|---|
| Temperature, °C.[2] | Feed | 180 | 280 | 300 | 320 |
| Phosphorus, ppm | 77 | 55 | 6 | 3 | 1 |
| Halogens, ppm | 90 | 80 | 60 | 30 | 17 |

[1]Norske Esso 130N TFE distillate, vacuum fractionated (i-95% blend) and filtered with 3 micron filter. This pretreatment reduced the phosphorus and halogen levels of the feed to the reported levels before guard bed treatment.

[2]Other conditions: 3.4 MPa $H_2$, 1.0 LHSV, 1.5 $kmol/m^3$ hydrogen gas rate.

[3]The used oil had not been subjected to the heat soaking step.

The effectiveness of alumina treating a heat soaked WFE distillate was also studied in the pilot plant. Results shown in Table 12 indicate that once again the major changes across alumina treating are removal of phosphorus, halogen and trace metals from the WFE distillate.

TABLE 12

ALUMINA TREATING WFE (HEAT SOAKED) DISTILLATE

| | Feed[1] | |
|---|---|---|
| Conditions | | |
| LHSV | — | 1.0 |

TABLE 12-continued

| ALUMINA TREATING WFE (HEAT SOAKED) DISTILLATE | Feed[1] | |
|---|---|---|
| Gas Rate, kmol/m$^3$ | — | 7.5 |
| Temperature, °C. | — | 320 |
| Pressure, MPa $H_2$ | — | 3.5 |
| Inspections | | |
| Density kg/dm$^3$ @ 15° C. | 0.8703 | 0.8703 |
| Viscosity, cSt @ 40° C. | 30.46 | 30.71 |
| Viscosity, cSt @ 100° C. | 5.17 | 5.20 |
| VI | 98 | 98 |
| Total Nitrogen, wppm | 150 | 160 |
| Basic Nitrogen, wppm | 36 | 41 |
| Sulfur, wt. % | 0.25 | 0.23 |
| Color, ASTM | D8 | D8 |
| Phosphorus, wppm | 20 | <3 |
| Halogens, wppm | 140 | 61 |
| Metals, ppm | | |
| Pb | 12 | 1 |
| Si | 11 | 1 |
| Ca | 7 | 2 |
| Zn | 5 | 2 |

[1]Derived from used oil feedstock B. Results of dewatering/defueling and heat soaking/WFE distilling of this feed are shown in Tables 3 and 7, respectively.

HYDROTREATING

The final processing step is hydrotreating the alumina treated oil over a conventional catalyst to produce the finished re-refined base oil. The conditions are quite similar to those used in conventional raffinate hydrotreating, i.e., about 260°-400° C., preferably about 260° C.-320° C., about 3-11 Mpa, preferably about 3-5 Mpa $H_2$ pressure, about 0.5-4 LHSV, preferably about 0.5-2.0 LHSV and about 1.5-15 kmol/m$^3$, preferably about 1.5-5.0 kmol/m$^3$ gas rate.

As a result of the improvements on the hydrofiner feedstock quality (i.e., phosphorus, sludge and halide removal) due to the previously recited processing steps, smooth hydrofiner operations and good quality base oils are secured. While operating on the clean distillate resulting from the previously identified processing sequence, about 1,500 hours of continuous pilot plant hydrotreating were logged with no noticeable catalyst (Ni/Mo) deactivation.

Base oils were made for quality evaluation (base oil target in the example was a 10 grade oil) by hydrotreating oils prepared by the above processing steps, i.e., the feed for each step was the product obtained from the preceding step in sequence. The oil was hydrotreated over Ni/Mo catalyst (CO/MO catalyst can also be used) at the conditions shown in Table 13. Inspections of a virgin SAE 10-grade oil made from Western Canadian crude are also shown in the same table for comparison purposes. Results indicated that the rerefined (280° C.-300° C.) oils derived from a Canadian used oil closely matched the virgin base oil in physical properties and chemical compositions.

Suitable catalysts for this hydrotreating are the elemental metals and oxygen or sulfur-containing compounds of metals of Group VIB and Group VIII of the Periodic Table of the Elements, preferably the metals and the oxides and sulfides of these metals and mixtures thereof. Preference is given to a catalyst which contains both a metal of the sixth group of a compound of this metal and a metal of the eighth group of the Periodic Table or a compound of this metal. They can be supported on a carrier, such as silica, bauxite, clay or alumina. Preference is given to a carrier consisting, at least substantially, of alumina. Preferred catalysts include Co/Mo on alumina, Ni/Mo on alumina, wherein the cobalt, nickel and molybdenum are in the elemental, oxide or sulfide form, preferably the sulfide form.

TABLE 13

| HYDROFINING ALUMINA TREATED OIL | Feed[1] | | | SAE 10 GRADE |
|---|---|---|---|---|
| Conditions | | | | |
| LHSV | | | 1.0 | |
| Gas Rate, kmol/m$^3$ | | | 7.5 | |
| Temperature, °C. | | 290 | 284 | |
| Pressure, MPa $H_2$ | | 3.5 | 5.6 | |
| Inspections | | | | |
| Density, Kg/dm$^3$ @ 15° C. | 0.8703 | 0.8682 | 0.8682 | 0.8741 |
| Viscosity, cSt @ 40° C. | 30.71 | 29.46 | 29.55 | 29.50 |
| Viscosity, cSt @ 100° C. | 5.20 | 5.09 | 5.10 | 4.97 |
| VI | 98 | 99 | 99 | 90 |
| Total Nitrogen, wppm | 160 | 43 | 47 | |
| Basic Nitrogen, wppm | 41 | 23 | 24 | |
| Surphur, wt. % | 0.23 | 0.09 | 0.10 | 0.07-0.10 |
| Colour, ASTM | D8 | <1.0 | <1.0 | <1.0 |
| Halogens, ppm | 61 | <2 | <2 | — |
| Phosphorus, ppm | <3 | <1 | <1 | — |
| TAN, mg KOH/g | — | 0.02 | 0.01 | 0.02 typ |
| Aromatics, wt. % | — | 14.7 | 14.8 | |
| Saturates, wt. % | — | 83.3 | 83.2 | 80 min |
| Polars, wt. % | — | 1.7 | 1.8 | |
| G.C. Distillation (ASTM D2887) | | | | |
| IBP | | 307 | 308 | |
| 5% | | 359 | 359 | |
| 10% | | 371 | 372 | |
| Volatility % off @ 368°C. | | 8 | 8.5 | 10 max |

[1]Derived from used oil feedstock B (Table 1). Results on dewatering/defueling, heat soaking/WFE distillation and alumina treating are shown in Tables 3, 7 and 12, respectively.

The beneficial effects of the feed treatment in accordance with the present invention on hydrotreating operation is shown in the following example. Untreated TFE distillate (phosphorus ¢77 ppm), which had not been heat soaked or alumina treated, was hydrotreated with conventional catalysts (Ni/Mo or Co/Mo) at 290° C. to 330° C., 3.4 to 4.8 MPa pressure. The catalyst was quickly deactivated (the product color dropped from 0.5 to 2.0 ASTM, product sulfur increased from 0.2 to 0.6 wt.% within 180 hours of operation). Alumina guard bed treating is effective for removing phosphorus and halide compounds from the TFE (or WFE) distillate (see Tables 11 and 12). However, when the feed had not been first subjected to a heat soaking step the adsorbent bed plugged after about 200 hours of operation due to the presence of excess amount of sludge precursors in the non-heat soaked TFE (or WFE) distillate. Heat soaking prior to TFE or WFE distillation significantly reduces both phosphorus and sludge precursors in the TFE (or WFE) distillate (see Tables 5, 6, and 7). From this it can be seen that each of the recited steps is necessary for the successful practice of the present invention.

As an optional step, the distillate coming from the distillation unit (TFE or WFE, for example) may be subjected to a second heat soaking and settling prior to being fed to the guard bed and subsequently into the hydrotreater. This step should be practiced in the event the sludge content of the distillate is high (see, for example, the sludge content of the material obtained in Table 5). This optional second heat soaking/settling should be considered if the sludge content (toluene insolubles) of the distillate is greater than about 100 to 300 ppm.

Heat soaking (e.g. at preferably 320° C., ½ hour) prior to WFE distillation precipitated the majority of the phosphorus compounds and sludge precursors, but the distillate could still contain about 150–400 ppm of residual sludge at about 310° C. This sludge material is comprised of about 100–300 ppm of toluene insolubles (as measured at room temperature) which are usually present in the freshly made distillate, and about 50–100 ppm of sludge that can form at the high temperature of 300° C.–320° C. (from the sludge precursors). This sludge material, especially the toluene insolubles, should be removed from the distillate prior to adsorbent treating in order to avoid plugging of the guard reactor bed.

By allowing the distillate to stand for a period of time (48–72 hours) at a moderate temperature (125° C.–150° C.) under quiescent conditions, these particulates tend to settle out of the oil. Results shown in Table 14 indicated that the settling rate of toluene insolubles was enhanced with increasing temperature. After standing at 150° C. for 72 hours, the distillate toluene insolubles dropped from an initial value of about 200 ppm to about 15 ppm. The sludge from the sludge precursors was also reduced from about 300 ppm to less than 150 ppm, which is at the lower limit of accurate measurement by the sludge test.

TABLE 14

EFFECT OF POST-HEAT SOAKING/SETTLING ON TOLUENE INSOLUBLES IN WFE DISTILLATE

| | Toluene Insolubles, ppm[1] Post-Heat Soaking (Residence Time, hrs.) | | | | |
|---|---|---|---|---|---|
| Temperature, °C. | 0 | 24 | 40 | 72 | 120 |
| | (Fresh Distillate) | | | | |
| 25 | 230 | 112 | 110 | — | 100 |
| 150 | 298 | 92 | 44 | 15 | 7 |

[1]Distillate was made from pre-heat soaked oil (at 320° C., ½ hour residence time) and subsequently distilled using the lab Pope WFE. The distillate was allowed to settle for different time periods at 25° C. and 150° C.

What is claimed:

1. A process for re-refining used oils so as to produce a basestock oil essentially equivalent in quality to basestock produced from virgin crude oil which process comprises the steps of:

(A) heat soaking the used oil at from 250° C.–340° C. for a time sufficient to maximize halide, phosphorus and sludge precursors removal by conversion of these materials into materials which go with the residue during the distillation step;

(B) passing the entire contents of the heat soaker directly to coke resistant distillation means;

(C) distilling the contents from the heat soaker under conditions of residence time, temperature and pressure selected to produce a distillate whose end point is essentially that of the target stock product and a residue;

(D) passing the distillate through a guard bed of activated material capable of removing residual phosphorus, halides and sludge from the distillate;

(E) hydrotreating the guard bed treated distillate under standard hydrotreating conditions, thereby producing a re-refined base stock.

2. The process of claim 1 wherein the used oil subjected to the re-refining process is a used lube oil.

3. The process of claim 1, wherein the heat soaking step is preceded by a dewatering and defueling step.

4. The process of claim 1 wherein the dewatering and defueling step is practiced using distillation.

5. The process of claim 1 wherein the heat soaking step is conducted at a temperature of about 280° to 320° C. for from about 15–120 minutes.

6. The process of claim 1, 3 or 5 wherein the heat soaking is conducted for from about 30 to 120 minutes.

7. The process of claim 6 wherein the distillation is conducted in a thin film evaporator, a wiped film evaporator or a cyclonic distillation tower.

8. The process of claim 1 wherein the guard bed is a bed of Fuller's Earth, charcoal, lime or activated alumina.

9. The process of claim 7 wherein the guard bed is a bed of activated alumina.

10. The process of claim 7 wherein the guard bed is run at a temperature of about 180° to 340° C., a pressure of about atmospheric to 5 MPa, a LSHV of about 0.5 to 2 v/v/hr.

11. The process of claim 10 wherein the hydrotreating is conducted at a temperature of from about 260°–400° C., a hydrogen pressure of about 3–11 MPa, a LSHV of about 0.5–4, and a gas rate of about 1.5–15 kmol/m$^3$.

* * * * *